US006041569A

United States Patent [19]

Freeman et al.

[11] Patent Number: 6,041,569

[45] Date of Patent: Mar. 28, 2000

[54] MAILING MACHINE HAVING ENVELOPE CLOSING AND SEALING DEVICE

[75] Inventors: Gerald C. Freeman, Norwalk; Norman R. Lilly, Shelton, both of Conn.

[73] Assignee: Pitney Bowes Inc., Stamford, Conn.

[21] Appl. No.: 08/890,789

[22] Filed: Jul. 11, 1997

[51] Int. Cl.[7] ..... B65B 7/20

[52] U.S. Cl. ..... 53/131.2; 53/284.3; 53/378.3; 493/245; 493/260; 493/453

[58] Field of Search ..... 705/406, 408, 705/410; 156/441.5, 442, 442.1; 493/245, 263, 260, 453, 438, 437; 53/569, 284.3, 378.3, 131.2, 411

[56] References Cited

U.S. PATENT DOCUMENTS

| | | | |
|---|---|---|---|
| 4,393,386 | 7/1983 | DiGiulio | 347/4 |
| 4,851,663 | 7/1989 | Denzin et al. | 250/223 R |
| 4,955,483 | 9/1990 | O'Dea | 209/548 |
| 4,971,686 | 11/1990 | O'Dea | 209/548 |
| 5,166,883 | 11/1992 | Gilham | 364/464.02 |
| 5,178,224 | 1/1993 | DiGiulio et al. | 177/25.15 |
| 5,321,436 | 6/1994 | Herbert | 346/140 R |
| 5,628,249 | 5/1997 | Cordery et al. | 101/91 |
| 5,684,706 | 11/1997 | Harman et al. | 364/464.16 |
| 5,740,728 | 4/1998 | DeBarber et al. | 101/93 |

FOREIGN PATENT DOCUMENTS

| | | | |
|---|---|---|---|
| 282938 | 5/1965 | Australia | 156/442.1 |

*Primary Examiner*—Edgar Burr
*Assistant Examiner*—Daniel J. Colilla
*Attorney, Agent, or Firm*—Alberta A. Vitale; Angelo N. Chaclas; Melvin J. Scolnick

[57] ABSTRACT

A mailing machine has an envelope transport device extending longitudinally therethrough and a digital ink jet printing device located adjacent the downstream end of the transport device. Due to the criticality of the spacing between the upper surface of an envelope and the discharge nozzles of the ink jet print head, the envelopes passing through the mailing machine must have their upper surfaces registered with a fixed plane that extends in spaced relationship with the nozzles. The mailing machine includes a flap closing device having fixed and movable elements that can accommodate variations in thickness of the envelopes extending from the registration plane downwardly within a fixed range so that the flap closing device can simultaneously close the flaps of both thin and thick envelopes passing through the mailing machine in a mixed stream.

21 Claims, 10 Drawing Sheets

MAILING MACHINE HAVING ENVELOPE CLOSING AND SEALING DEVICE

BACKGROUND OF THE INVENTION

The present invention relates generally to the field of high volume, high speed mailing machines for printing postage indicia on a succession of envelopes passing therethrough, and more particularly to such mailing machines having a digital ink jet printing device and an envelope flap closing and sealing device for closing and sealing the flaps of envelopes just prior to the printing operation.

Mailing machines of the type to which the present invention pertains have long been well known and have achieved a very high degree of commercial success. Mailing machines of this type typically include an elongate feed deck, an envelope conveyor mechanism extending along the feed deck, a hopper for holding a stack of envelopes with the flaps still open, a flap closing and sealing device located just downstream from the hopper, and a postage metering device mounted over the feed deck just downstream from the flap closing and sealing device. The postage meter typically includes an accounting device for monitoring the amount of postage used, and a printing device for printing a postage indicia on envelopes being conveyed along the feed deck. The postage meter further includes a postage amount setting mechanism for setting varying amounts of postage into the printing device, which is either a rotary drum holding a curved die on which the postage indicia is engraved, or a flat plate holding a flat die on which the postage indicia is engraved. In either case, each time an envelope is fed past the printing device, the die is inked by a suitable inking device and the ink is transferred to the envelope, either by rotation of the drum or by momentary pressure contact with the flat die.

Mailing machines utilizing this form of printing technology have worked quite well in various commercial applications despite certain drawbacks, such as mechanical complexity which entails a relatively high level of manufacturing and maintenance costs, limitations on the speed at which the machines can run due to the necessity of reinking the printing dies between each printing operation, and physical size and weight, which have also been a problem and the source of numerous customer complaints, particularly in professional offices where space is at a premium, since these machines tend to be rather large.

A significant technological breakthrough in the design and development of mailing machines of the type under consideration has been the development and refinement of digital ink jet printing technology over the past decade or so. To understand this, it must be understood that the printing of postage meter indicia on envelopes involves certain very critical characteristics. One is that, since a postage meter is, in effect, printing money in a specialized form, i.e., the postage indicia represents the payment to the U.S. Postal Service by the owner of the mailing machine for the privilege of having his mail delivered to an addressee, the quality of printing must be exceptionally high so that the indicia is visibly clear and devoid of any smudges and blurs for verification of authenticity and for mail sorting purposes, since genuine postage meter ink contains a die which is machine readable. Another characteristic is that the postage meter printing device must be highly reliable in operation and must print an acceptable indicia the first time on each envelope, since each printing represents the expenditure of money and therefore printings of inferior quality which must be discarded is commercially unacceptable. Thus, it has only been within the above mentioned time frame that ink jet technology has been refined and improved to the point where the quality of printing, speed of operation, and cost of manufacture and operation have become commercially acceptable for use in a mailing machine environment.

One of the major problems encountered in the development of a mailing machine utilizing the ink jet technology for printing the postage indicia, the solution to which the present invention is directed, is that of properly closing and sealing the flaps of envelopes traveling through the mailing machine which are of varying thickness. In the prior type of mailing machines discussed above, the envelopes traveled through the mailing machine on an elongate flat deck, the envelopes being conveyed along the deck by any suitable combination of rollers and/or belts. The deck was fixed in the mailing machine and the upper surface thereof defined a registration plane for the lower surface of the envelopes, referred to hereinafter as bottom registration. Varying thickness in the envelopes was accommodated by limited vertical movement of the printing die assembly in the postage meter. Thus, the typical forms of flap closing devices utilized in those machines was merely a strip of metal bent to a particular shape and forming an elongate blade, or alternatively a particularly shaped rod forming an elongate guide, the purpose in either case being to gradually urge the envelope flap through approximately a 90° angle to cause it to pass through a suitable aperture in the deck and lie contiguous to the under surface of the rear panel of the envelope. During further movement of the envelope, it passed beneath a sealing roller which pressed the premoistened edge of the flap into contact with the rear panel with sufficient pressure to cause it to seal just prior to the envelope reaching the printing mechanism of the postage meter.

The significant factor of the bottom registration arrangement, as it relates to the present invention, is that the deck forming the registration plane is fixed, with the result that the rear panel of the envelope is always in the same plane, thereby permitting the flap closing device to be formed as a relatively simple, single piece, stationary element, since any variation in thickness of envelopes passing through the mailing machine is compensated for by movement of the printing die in the printing device of the postage meter, or by a short pressure deck under the die that could distort the envelope slightly during the printing cycle.

With printing devices utilizing ink jet technology, the situation is entirely different. Firstly, in order for the ink jet nozzles of any ink jet printer to deposit ink on the surface of the receiving medium, it is critical that a small predetermined gap be maintained between the exit plane of the nozzles and the surface of the receiving medium, typically in the order of one sixteenth to one thirty-second of an inch. This gap is necessary to achieve proper image quality, since too small a gap causes excessive ink to be deposited in the actual image area, and too large a gap results in too little ink being deposited, resulting in a blurred or fuzzy image. Thus, in the mailing machine environment, it becomes necessary to maintain this critical gap between the exit plane of the ink jet nozzles and the upper surface of the envelopes being conveyed through the mailing machine.

To accomplish this, the envelopes must be conveyed with the front panels on which the postage indicia is printing lying in a fixed registration plane, which is disposed beneath the exit plane of the nozzles a distance equal to the aforementioned gap. This arrangement is referred to hereinafter as top registration, as distinguished from the above described bottom registration in the prior mailing machines.

The problem that arises, however, with top registration is that the plane of the rear panel of the envelopes is not fixed, as is the case with bottom registration, but rather must shift vertically in accordance with variations in the thickness of envelopes being conveyed through the mailing machine. Thus, in order for a flap closing device to operate effectively in this arrangement, the flap closing device must also shift vertically in synchronism with varying vertical positions of the rear panel of envelopes depending on the thickness of the envelopes.

Experience has shown that to redesign known flap closing devices that are fixed in prior mailing machines, since they are designed for bottom registration, to make them movable so as to shift vertically in synchronism with the varying positions of the rear panels of envelopes of varying thickness, would require a substantially complex mechanical and electronic design. It would, of course, be possible to provide a simple manual adjustment for the flap closing device which could be preset for varying thickness of envelopes, but this would require that all envelopes being fed through the mailing machine be of the same thickness, and this would so detract from the utility of the mailing machine as to render it virtually commercially unacceptable. Thus, even with top registration, the mailing machine must be capable of accepting envelopes of varying thickness in different batches of envelopes of the same thickness, or as mixed thickness within the same batch. To do this with conventional flap closing devices would require a sensing device to measure the thickness of each envelope passing through the mailing machine, which would have to be very accurate and have a rapid response time. The arrangement would also require some type of mechanical shifting mechanism that would be responsive to the sensing device and which would also have to operate very rapidly in order to shift the position of the flap closing device by the required amount for each successive envelope. It should be apparent that this arrangement would greatly increase the complexity of the flap closing device of the mailing machine, thereby substantially increasing the cost of manufacture and maintenance and decreasing the reliability and efficiency of operation, resulting in a product that is commercially less attractive than at present.

Thus, there is a substantial need for relatively simple, inexpensive and highly reliable flap closing device for envelopes of varying thickness being fed successively through a mailing machine which utilizes the top registration concept of positioning envelopes for proper printing.

BRIEF SUMMARY OF THE INVENTION

The present invention substantially obviates, if not entirely eliminates, the disadvantages of the prior mailing machines by providing a highly effective envelope flap closing and sealing device for mailing machines utilizing a digital ink jet printing device, which thereby requires that the upper surfaces of envelopes being conveyed through the mailing machine be registered with a plane disposed at a critical predetermined distance beneath the plane of the discharge nozzles of the ink jet print head. The flap closing device of the present invention includes features of novel design and construction that enable it to accommodate a succession of envelopes of varying thickness in which the variations in thickness occur both within batches of envelopes of different thickness but all envelopes in a batch are of the same thickness, and with batches of envelopes of varying thickness within the batch. Further, the flap closing device is capable of completing the closing of the flap of a preceding envelope while simultaneously commencing the closure of the flap of a succeeding envelope, so that the envelopes can be fed successively with minimum spacing between successive envelopes, typically in the order of two inches.

Thus, in its broader aspect, the present invention is a mailing machine for printing postage indicia on the upper surface of a succession of top registered envelopes passing through the mailing machine with the flaps of the envelopes open and extending generally downwardly from the upper surface of the envelopes. The mailing machine comprises means defining an envelope feed path extending through the mailing machine, an envelope transport mechanism extending along the feed path for transporting envelopes therealong from an infeed location to an outfeed location, and a digital ink jet printing device disposed adjacent the outfeed location of the feed path, the printing device including a print head having a plurality of ink jet nozzles for depositing ink in a predetermined image pattern on the upper surface of an envelope traveling along the feed path. The mailing machine further includes means defining a registration plane for the upper surface of envelopes being transported along the feed path from the infeed location toward the printing device, the registration plane being disposed at a predetermined distance beneath the ink jet nozzles. The mailing machine further includes an envelope flap closing device disposed adjacent the feed path in an upstream direction from the printing device for closing the flaps of successive envelopes as they are transported along the feed path prior to reaching the printing device, the flap closing device including means responsive to varying thicknesses of the envelopes for ensuring that the flaps thereof are effectively closed regardless of the thickness thereof within a predetermined range of thickness.

In some of its more limited aspects, the registration plane for the upper surface of the envelopes is defined in part by a fixed guide means extending along and partially overlying a portion of the feed path in a position to be contacted by the upper surfaces of envelopes being transported along the feed path, and having a lower surface disposed at the predetermined distance beneath the ink jet nozzles so as to lie in the registration plane. The registration plane is further defined by a portion of the transport mechanism which lies in a plane which is coextensive with the lower surface of the guide means so as to also lie in said registration plane.

The flap closing device comprises a first flap closing element for partially closing the flaps of envelopes passing through the flap closing device, a second flap closing element for completing the closure of the flap on each envelope to bring the flap into contact with the rear surface of the envelope, and means mounting the second flap closing element for movement relative to the first flap closing element so that the second flap closing element causes the flap to be brought into contact with the rear surface of the envelope regardless of the thickness of the envelope within a predetermined range of thickness.

Each of the flap closing elements has a body member having a plurality of distinctive physical shape characteristics which cooperate in a unique manner to cause the flaps of successive envelopes passing through the flap closing device to be folded from a downwardly extending position to a position coextensive with the rear panels of the envelopes so that the pre-moistened gummed strips of the flaps will adhere to the rear panels of the envelopes. The movable flap closing element also includes a unique mounting means that enables it to simultaneously pivot and translate in order to accommodate successive envelopes of different thicknesses.

Having briefly described the general nature of the present invention, it is a principal object thereof to provide a mailing machine having a postage meter printing device which utilizes ink jet technology, and which is capable of closing and sealing the flaps of a succession of top registered envelopes being conveyed through the mailing machine regardless of variations in the thickness of the envelopes.

Another object of the present invention is to provide a mailing machine of the type described in which the flap closing device therein is capable of closing the flaps of a succession of top registered envelopes being conveyed through the mailing machine regardless of whether the variations in thickness occur in batches of envelopes of different thickness but all envelopes in each batch are of the same thickness, or with batches of envelopes of varying thickness within each batch.

Still another object of the present invention is to provide a mailing machine of the type described in which the flap closing device therein is capable of simultaneously completing the closure of the flap of a preceding top registered envelope of one thickness and commencing the closure of the flap of a succeeding top registered envelope of a different thickness to maintain the spacing between successive envelopes at a minimum.

A further object of the present invention is to provide a mailing machine of the type described in which the flap closing device therein is relatively simple in design and construction, and does not require any combination of complex and expensive envelope thickness measuring device and powered means for moving a flap sealing device.

These and other objects and features of the present invention will be more apparent from an understanding of the following detailed description of a presently preferred mode of carrying out the invention when considered in conjunction with the accompanying drawings.

DETAILED DESCRIPTION OF THE INVENTION

Figure 1:
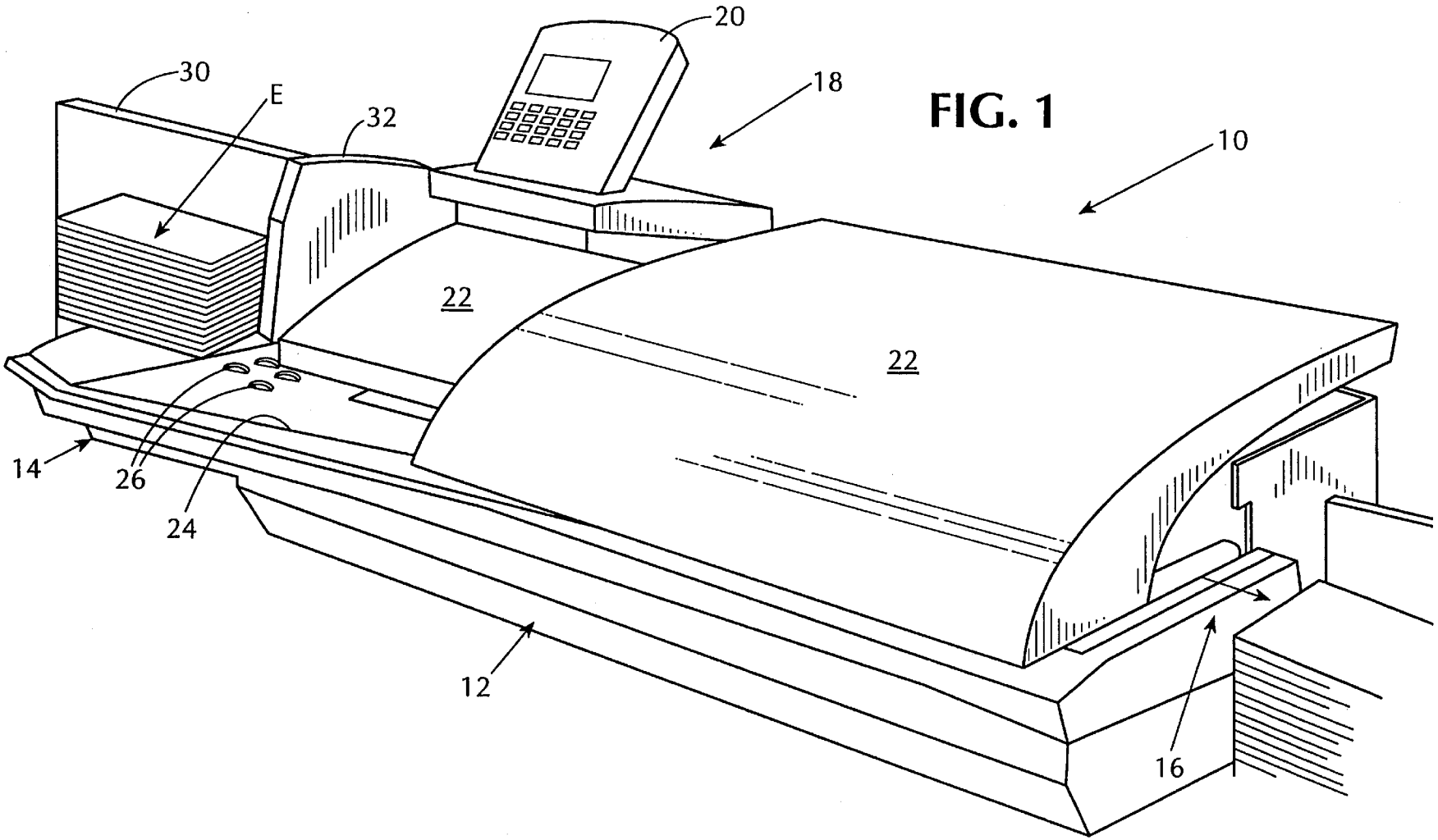
FIG. 1 is a perspective view of a typical mailing machine constructed and arranged in accordance with the principles of the present invention.
Figure 2:
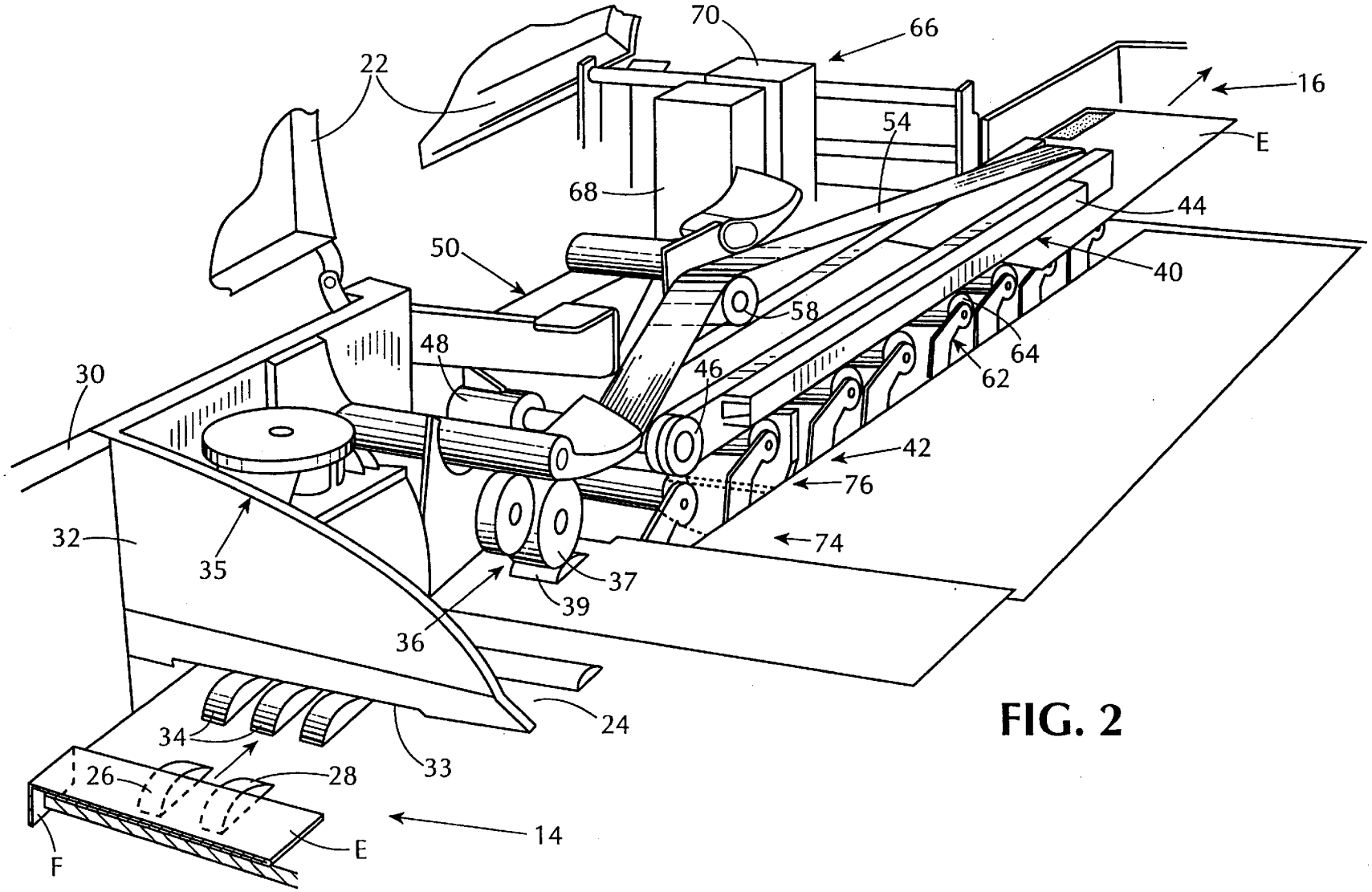
FIG. 2 is a perspective view of the mailing machine shown in FIG. 1 looking toward the envelope outfeed end thereof and showing certain details of the envelope conveying mechanism.

Referring now to the drawings, and particularly to FIGS. 1 and 2 thereof, the reference numeral 10 indicates generally a typical mailing machine incorporating the principles of the present invention, and comprises a base unit, designated generally by the reference numeral 12, the base unit 12 having an envelope infeed end, designated generally by the reference numeral 14 and an envelope outfeed end, designated generally by the reference numeral 16. A postage meter is suitably mounted on the base unit 12 generally in the vicinity of a cover, designated generally by the reference numeral 18, and a control panel and information display unit 20 is suitably mounted on the cover 18 so as to be conveniently accessible to an operator. A pair of cover members 22 are pivotally mounted on the base 12 so as to move from the closed position shown in FIG. 1 to the open position shown in FIG. 2 so as to expose various operating components and parts for service and/or repair as needed.

The base unit 12 further includes a horizontal feed deck 24 which extends substantially from the infeed end 14 approximately to the location of a flap closing device further described below. A plurality of nudger rollers 26 are suitably mounted under the feed deck 24 and project upwardly through openings 28 in the feed deck so that the periphery of the rollers 26 is slightly above the upper surface of the feed deck 24 and can exert a forward feeding force on a succession of envelopes, generally indicated by the letter E in FIG. 1, one of which is shown in section in FIG. 2 with the flap F thereof hanging downwardly behind the feed deck 24. An end portion of the deck 24 and a pair of vertical walls 30 and 32 define an envelope stacking location from which the envelopes E are fed seriatim from the bottom of the stack by the nudger rollers 26 to a plurality of conveyor belts 34 (FIG. 2) which convey a single envelope E through the various components of the mailing machine 10 in the manner further described below.

A suitable envelope separator or singulation device of a type known in the art, designated generally by the reference numeral 35, is suitably mounted on the base unit 12 beneath the upstream cover 22 and functions to ensure that only one envelope E at a time is fed from the stack into the mailing machine. Beyond the separator unit 35 is a take away roller assembly, designated generally by the reference numeral 36, which includes a pair of opposed feed rollers 37 and 39 for conveying the incoming envelope through a suitable moistening device which is also well known in the art and indicated only by a moistening belt 38 (FIG. 3), against which the gummed portion of the flaps of envelopes are pressed as the envelopes move through the mailing machine 10 by the roller assembly 36.

Figure 3:
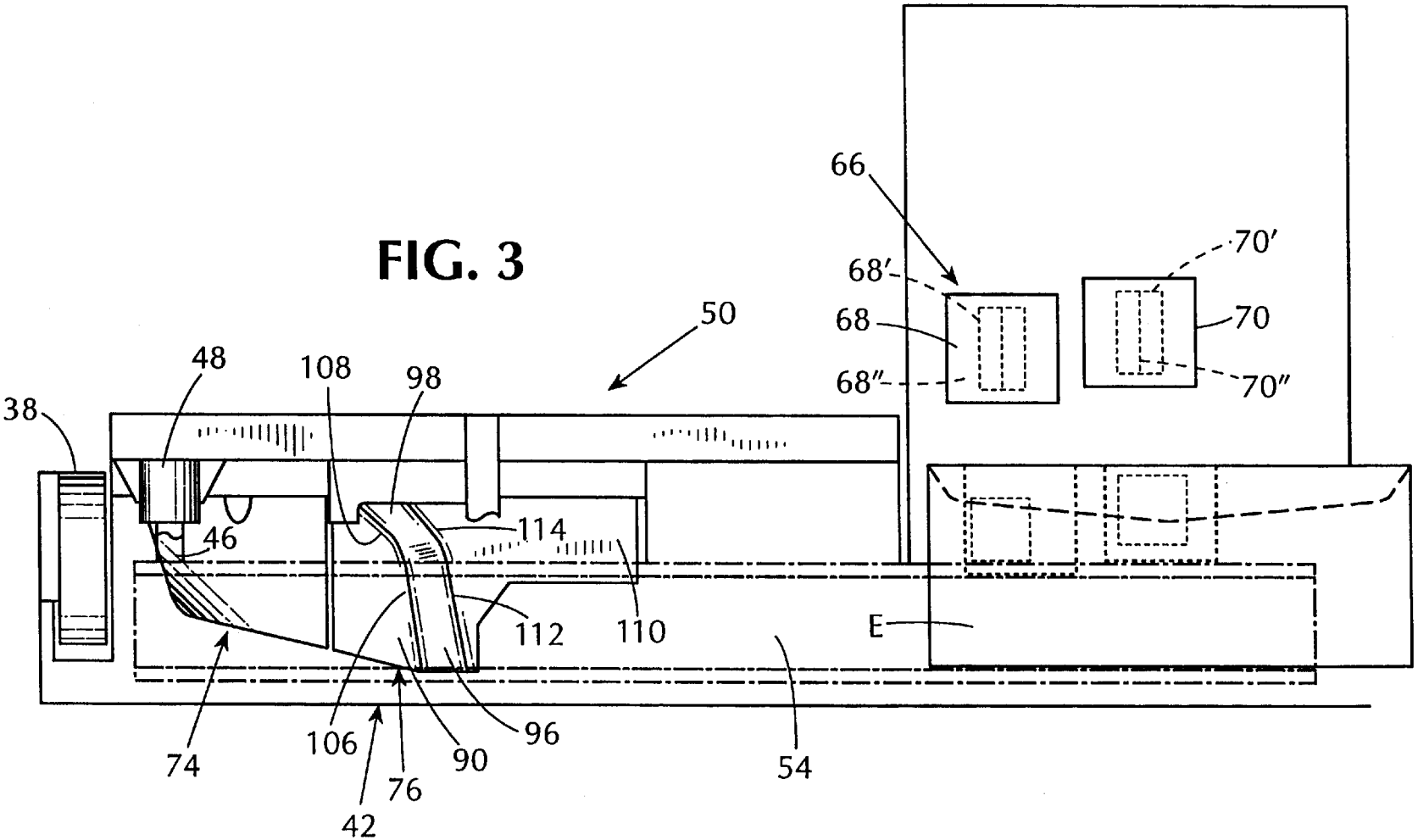
FIG. 3 is a plan view of a portion of the mailing machine shown in FIG. 2, with parts removed to show the relationship of the envelope flap closing device to the printing devices.
Figure 4:
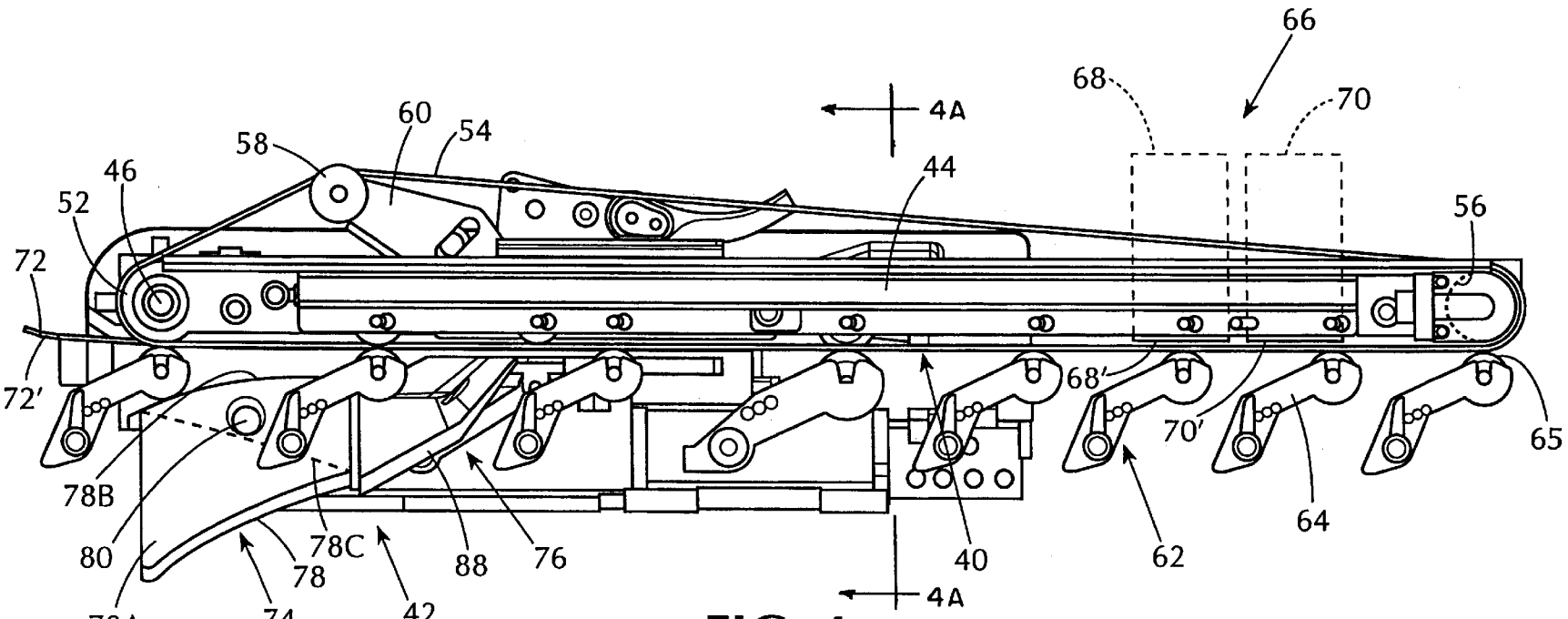
FIG. 4 is a front elevation of a portion of the mailing machine shown in FIG. 2 with parts removed to show details of the envelope conveyor mechanism.
Figure 4A:
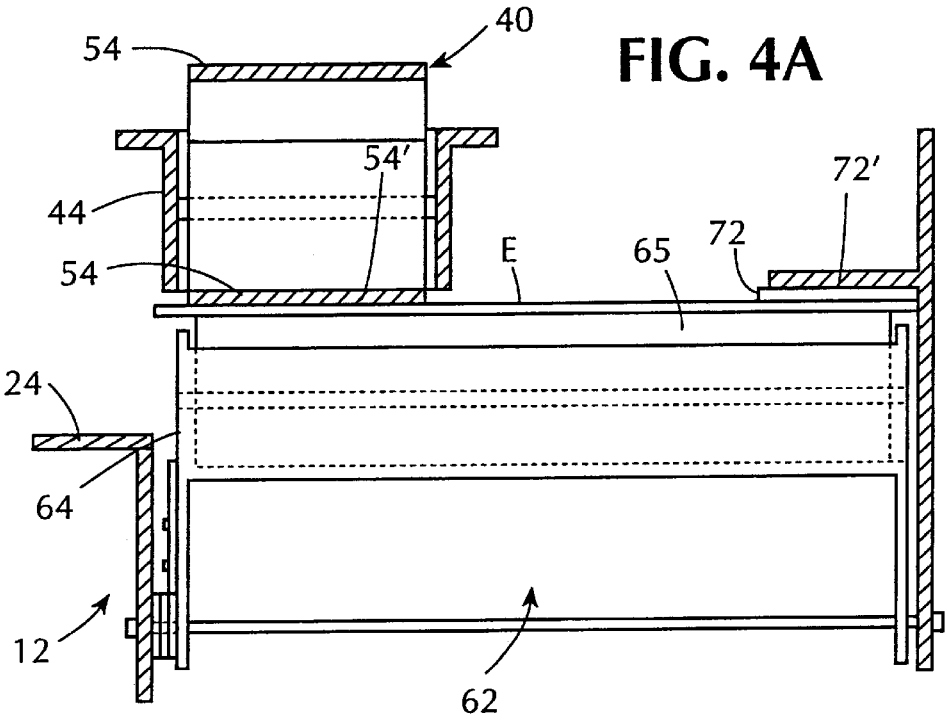
FIG. 4*a* is a cross sectional view of the mailing machine of FIG. 4 taken along line 4*a*—4*a* of FIG. 4.

With particular reference now to FIGS. 2 through 4, it will be seen that the take away roller assembly 36 feeds envelopes E directly to an elongate conveyor assembly, designated generally by the reference numeral 40 in FIG. 2. As will be described in further detail below, the conveyor assembly 40 conveys successive envelopes E from the take away roller assembly 36 past an envelope flap closing device, designated generally by the reference numeral 42. The conveyor assembly 40 comprises a suitable elongate frame 44 which is pivotally mounted on a shaft 46, which in turn is rotatably mounted in an outwardly protruding boss 48 of an elongate casting, designated generally by the reference numeral 50 and also seen in FIG. 5, suitably mounted on the base unit 12. A drive roller 52 is fixedly mounted on the shaft 46 for rotation therewith, and an endless belt 54 extends around the drive roller 52 and an idler roller 56 mounted adjacent the other end of the frame 44, the belt 54 also passing over a tensioning roller 58 mounted on the free end of a spring loaded arm 60 (FIG. 6) which is suitably mounted on the frame 44 so as to maintain proper operating tension on the belt 54.

A plurality of back up pressure roller assemblies, designated generally by the reference numeral 62, are suitably mounted on the base unit 12, each roller assembly 62 having a spring loaded arm 64 pivotally mounted on the base unit 12 and carrying a back up pressure roller 65 adjacent the free end thereof, the arrangement being such that the plurality of rollers 65 maintain an envelope E in firm driving engagement with the under surface of the lower run 54' of the belt 54, as seen in FIG. 2 and establish the top registration wall before printing occurs to avoid any possibility of distorting the upper printing surface and maintaining accurate tracking.

As best seen in FIGS. 2 and 3, the mailing machine 10 is provided with at least one or a pair of digital ink jet printing devices, designated generally by the reference numeral 66, which are suitably mounted on the base unit 12 adjacent the outfeed end 16 of the mailing machine 10, and which are of a type known in the art. At present it is necessary to have two printing devices 68 an 70 in order to be able to print a postage indicia the height of which exceeds the length of the nozzle array in a single printing device, although a single printing device would be preferable if one were available with a nozzle array long enough to print the full height of the postage indicia. Each printing device 68 and 70 has a lower surface, usually referred to as a nozzle plate and indicated as 68' and 70' which contains nozzle orifices 68" and 70" through which minute droplets of ink are expelled by suitable ink ejection activators. In a manner also well known in the art and therefore not shown or described in detail, the individual printing devices 68 and 70 are mounted for lateral movement toward and away from the path of movement of the envelope E, being shown in FIG. 3 in their storage or standby positions in solid lines, and in their operative printing positions in dotted lines. It will be apparent that as envelopes are fed successively through the mailing machine 10, the printing devices 68 and 70 are moved from the standby positions to the printing positions where they remain during the printing of a given batch of envelopes, being returned to the standby positions when printing has been completed on that batch.

As was briefly mentioned above, a critical feature of digital ink jet printing technology is that with any type of ink jet printing device such as the printing devices 68 and 70, there must be a very small gap between the nozzle plate 68' and 70' and the upper ink receiving surface of the medium on which printing is taking place. This gap is usually in the range of one sixteenth to one thirty second of an inch, and it must be maintained within this range in order to achieve a clear, sharp image. If the gap is too wide, the ink droplets being expelled from the nozzles tend to diffuse or spread too widely over the gap between the nozzles and the receiving surface, resulting in print elements which are slightly fuzzy or blurred at the edges, which prevents the overall image from being clear and sharp. In addition, if the gap is too large, the relative movement between the surface of the envelope and the printing device can cause the image to be slightly distorted because of variations in the velocity of the envelope, even though these variations may be very slight. On the other hand, if the gap is too small, the ink droplets are too concentrated or dense when they strike the receiving surface, resulting in print elements which contain an excessive amount of ink which may cause loss of detail. It will be recognized that maintaining this gap constant is not a problem in typical ink jet printing applications in which printing is taking place on a single sheet of paper, or other medium, which is being suitably supported from the underside by a fixed support means, since the thickness of the sheet of paper or other medium either never changes, or does not change significantly enough to adversely affect the quality of the printed image.

In a mailing machine, however, in which a postage indicia is being printed on envelopes of varying thickness, it is impossible to provide a fixed support for the envelopes and still maintain the aforementioned gap between the nozzle plate and the upper surface of the envelopes, because the location of the upper surface would vary in accordance with the thickness of the material in the envelopes. Therefore, the upper surface of the envelopes must be maintained in a fixed plane within the mailing machine which is disposed at a location that is a predetermined distance beneath the plane of the nozzle plate of the ink jet print head, which corresponds to the gap that is required to be maintained between the nozzle plate and the upper ink receiving surface of the envelopes.

Thus, with reference to FIG. 4, a small guide plate 72 is suitably mounted on the base unit 12 so as to intercept the lead edge of envelopes E exiting from the take away roller assembly 36. The guide plate 72 is positioned such that the lower surface 72 thereof is contiguous with the under surface of the lower run 54' of the belt 54, so that these lower surfaces establish the registration plane for the upper surfaces of the envelopes as they move through the flap closing device 42 and past the pair of printing devices 66. The individual printing devices 68 and 70 are indicated in phantom lines in FIG. 4 to show the approximate location of the nozzle plates 68' and 70' in relation to the registration plane represented by the lower surface of the run 54' of the belt 54, i.e., to show the aforementioned gap between the nozzle plates 68' and 70' and the upper surfaces of the envelopes.

Figure 5:
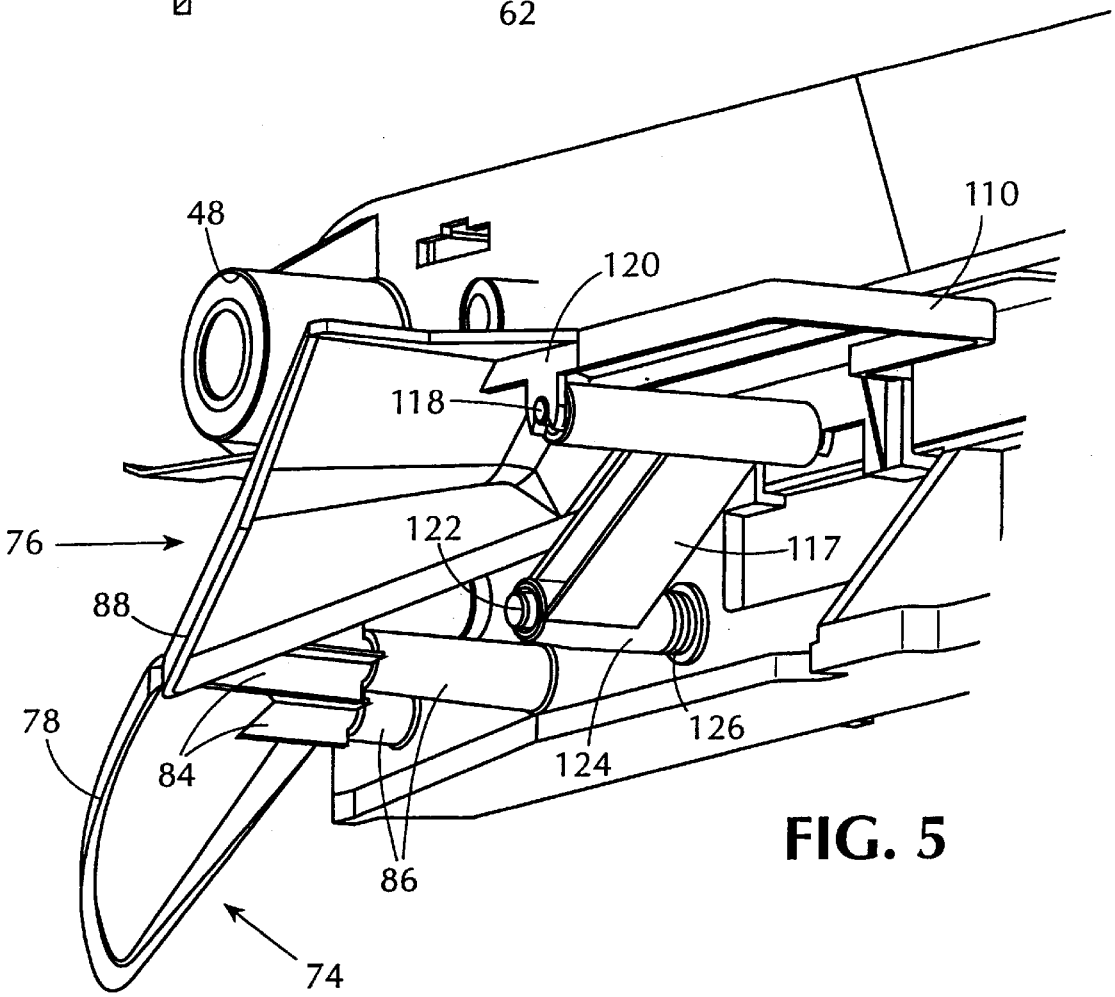
FIG. 5 is a perspective view, drawn to an enlarged scale, of the envelope flap closing device, looking upwardly at the underside thereof from the downstream end toward the upstream end.

With reference now to FIGS. 3 through 9, but more particularly FIGS. 5 through 9, the envelope flap closing device 42 is seen to comprise a fixed flap closing element indicated generally by the reference numerals 74 and a movable flap closing element indicated generally by the reference numeral 76, the terms fixed and movable being used to indicate generally the manner in which the respective flap closing elements are mounted on a portion of the casting 50. The fixed flap closing element 74 comprises a relatively thin body member 78 that has a generally rectangular configuration when viewed from the top, as best seen in the perspective view of FIG. 6, and it has a compound curvature in which the triangular shaped sections 78A and 78B on either side of a diagonal axis 78C are curved downwardly as viewed in FIG. 6, or away from the upper surface of the body member 78, so as to define a convex surface across the diagonal axis 78C. The fixed flap closing element 74 is fixedly mounted on a portion of the casting 50 by a suitable screw which passes through an aperture 80 formed in a protruding boss 82 formed on the under surface of the section 78B of the body member 78, the screw being threaded into another outwardly protruding boss (not shown) formed on the casting 50. As best seen in FIG. 5, a pair of elongate protruding abutment bosses 84 are also formed on the under surface of the body member 78 which abut a corresponding pair of outwardly protruding bosses 86 formed on the casting 50 when the body member 78 is secured thereto to stabilize the body member 78 so that it remains in a fixed position.

Figure 6:
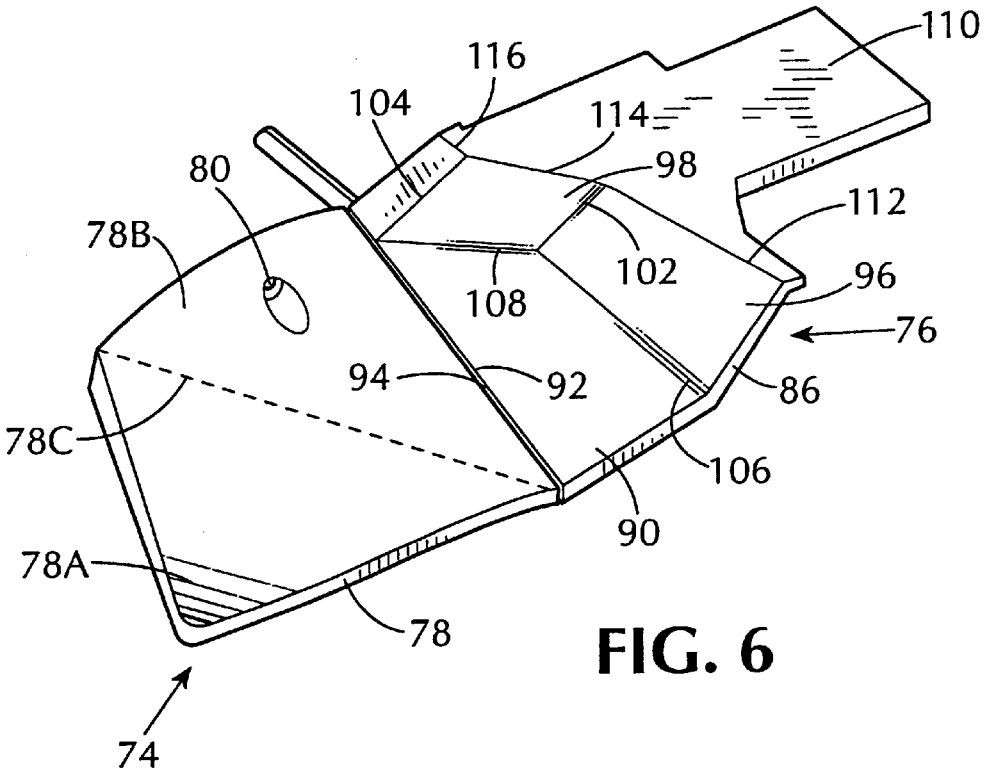
FIG. 6 is a perspective view of the envelope flap closing device looking downwardly at the upper surface.
Figure 9:
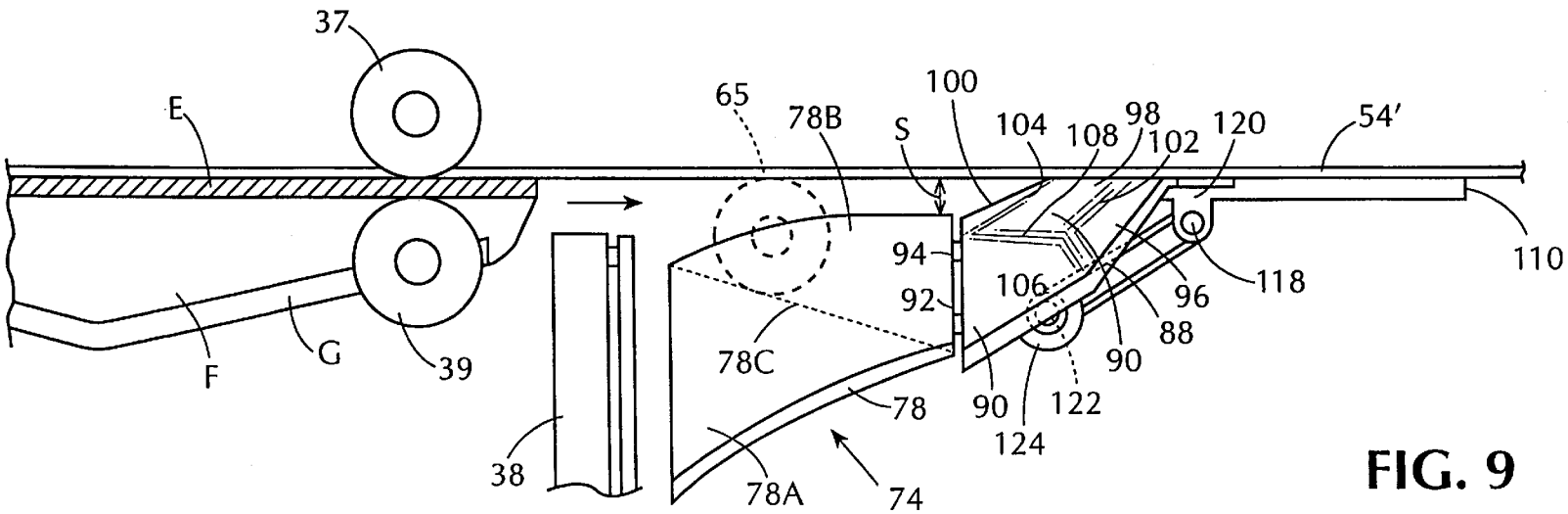
FIG. 9 is a side view of the flap closing device as shown in FIG. 8.

With reference to FIGS. 6 and 9, when the fixed flap closing element 74 is secured to the casting 50 in the manner described, the entire body member 78 is disposed below the registration plane as defined by the under surface of the lower run 54' of the belt 54, and therefore below the level of an incoming envelope E, as best seen in FIG. 9. The outer end of the curved section 78A extends downwardly sufficiently far to be disposed below the level of the flap F of the incoming envelope E so as to be engaged by the flap F in order to initiate further closure thereof from the extent to which it is partially closed by the sealing device represented by the moistening belt 38, both in the manner fully explained below in connection with the description of operation of the complete flap closing device. Also, the compound curvature of the body member 78 is generally angled upwardly both in the longitudinal direction of movement of the envelopes E through the mailing machine 10 and in a lateral direction that is perpendicular to the direction of movement of the envelopes E, for a purpose also further explained below.

Figure 7:
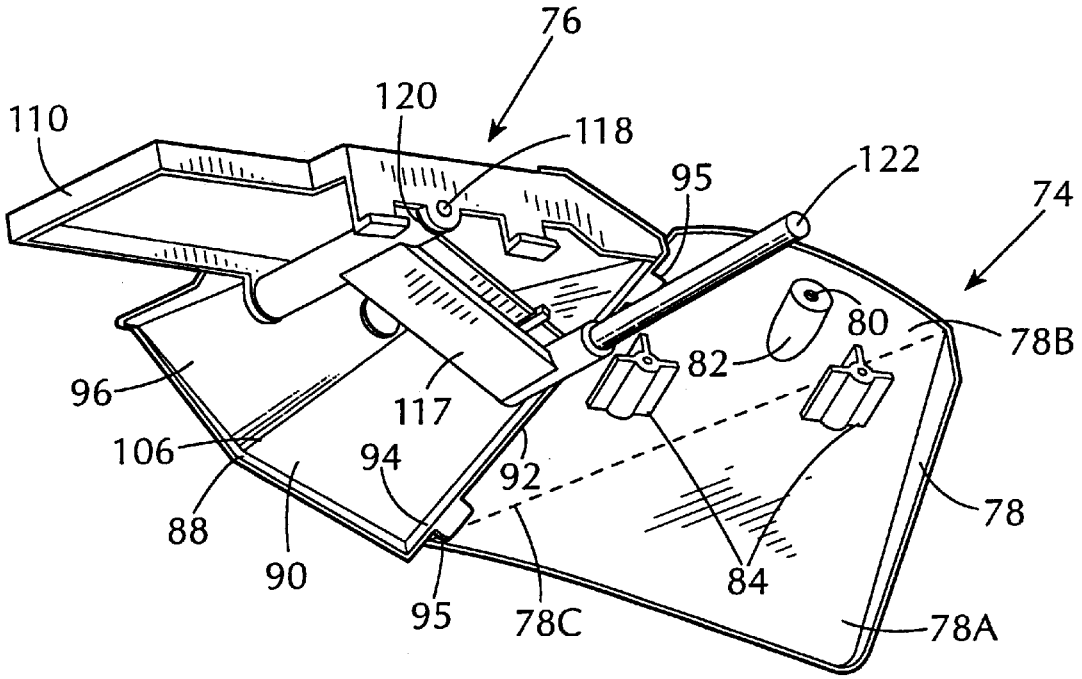
FIG. 7 is a perspective view of the envelope flap closing device oriented 180° degrees from FIG. 6 and looking upwardly at the underside of the device.
Figure 8:
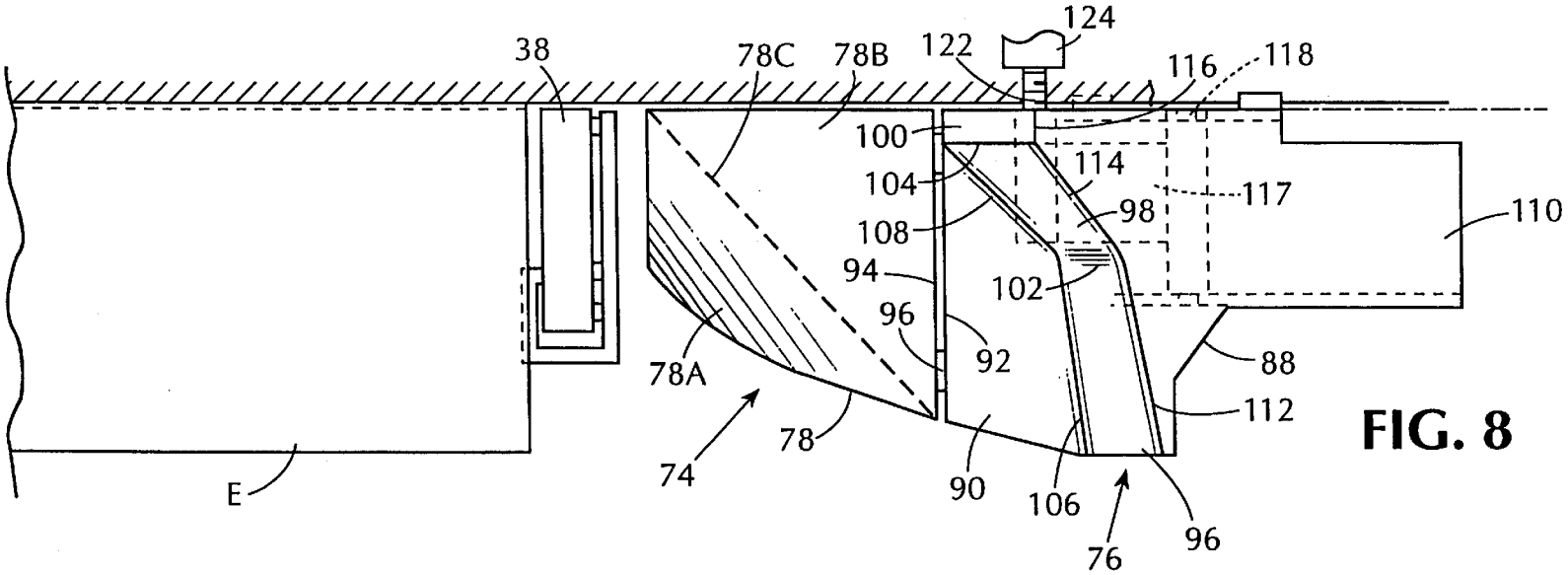
FIG. 8 is a fragmentary plan view, drawn to an enlarged scale, of a portion of the mailing machine as shown in FIG. 3 which shows an envelope about to enter the flap closing device.

The movable flap closing element 76 has a considerably more complex shape that does the fixed flap closing element 74 just described, and in addition is movably mounted in the mailing machine to effect final closure of the flaps on successive envelopes regardless of the varying thickness thereof. Thus, with reference still to FIGS. 3 through 9, and more particularly FIGS. 5 through 9, the movable flap closing element 76 comprises a relatively thin body member 88 which has a plurality of discrete planar portions which cooperate together in a unique manner to complete the flap closing and sealing operation in the mailing machine 10. As best seen in FIGS. 6, 7 and 8, the body member 88 has a first planar portion 90 which has an upstream edge 92 that is coextensive with a major portion of the length of the corresponding downstream edge 94 of the body member 78 of the fixed flap closing element 74. The edge 92 is provided with a pair of tabs 95 which are adapted to abut the underside of the body member 78 when the body member 88 of the movable flap closing element 76 is installed on the casting 50 in the manner further described below. As best seen in FIG. 9, the upstream edge 92 of the first planar portion 90 is also disposed below the registration plane by the same amount as the downstream edge 94 of the body member 78, and therefore below the level of the incoming envelope E, and actually forms a continuation of the upwardly angled surface of the downstream triangular portion 78B of the movable flap closing element 76, as best seen in FIG. 6. Also, as best seen in FIGS. 6 and 9, the planar portion 90 is angled upwardly in the direction of movement of the envelopes E at approximately a 45° angle, and is also angled upwardly in a direction perpendicular to the direction of movement of the envelopes E, the purpose of this angular orientation being further explained below.

A series of second, third and fourth planar portions 96, 98 and 100 respectively all have generally rectangular configurations, as best seen in FIG. 6, and are joined together by angled junctures 102 and 104 respectively. The portions 96 and 98 are also joined to the first planar portion 90 by angled junctures 106 and 108 respectively, and are angled upwardly more sharply than the planar portion 90 in the longitudinal direction of movement of the envelopes E, again for a purpose fully explained below. The planar portion 100 is a relatively narrow strip that is elongate in the direction of movement of the envelopes and is angled upwardly in that direction to act as a camming surface by which the leading edge of the envelopes move the entire secondary flap closing device 76 angularly or downwardly, as more fully explained below, to permit the movable flap closing device 76 to accommodate envelopes of varying thickness. Also as best seen in FIG. 6, the angled junctures 102, 106 and 104 are more in the nature of radius curves rather than sharp angles so as to provide a smooth and gradual transition from the plane of the first portion 90 to the planes of the second and third portions 96 and 98 to prevent any possibility of the lead edge of the flap F of an envelope E from snagging on the movable flap closing element 76.

Finally, a fifth planar portion 110, which is elongate in the direction of feed of the envelopes E and is of generally rectangular configuration, is joined to the second, third and fourth planar portions 96, 98 and 100 respectively, along the angled junctures 112, 114 and 116 respectively. These angled junctures are less rounded than the junctures 102, 106 and 108 since there is no possibility that the lead edges of envelopes could snag on these junctures. As best seen in FIGS. 6 and 9, the fifth planar portion 110 is flat and disposed in a horizontal orientation which, in a normal or home position, is contiguous with the registration plane, i.e., the under surface of the lower run 54' of the belt 54. As will be more fully explained below, the first planar portion 90 as well as the second and third planar portion 96 and 98, constitute an area of the movable flap closing element 76 that effects closure of the envelope flap from the extent of closure effected by the fixed flap closing element 74 to full closure and sealing of the flap to the rear panel of the envelope.

As previously briefly mentioned, the movable flap closing element 76 is mounted in the mailing machine 10 for simultaneous limited pivotal and translational movement as further described to accommodate envelopes of varying thickness, and to permit an envelope of one thickness to enter the flap closing device 42 while another envelope of a different thickness is exiting the flap closing device 42. Thus, as best seen in FIGS. 5, 7 and 9, an elongate arm 117 is pivotally secured as by a pivot shaft 118 connected to the upper end of the arm 117 and mounted in a bracket 120 suitably connected to the underside of the fifth planar portion 110 closely spaced from the juncture 112 thereof with the second planar portion 96. Thus, the entire movable flap closing element 76 can pivot in clockwise and counter clockwise directions about the pivot shaft 118.

In addition, as best seen in FIG. 5, the lower end of the arm 117 is pivotally connected to another pivot shaft 122 which is mounted in a boss 124 which protrudes outwardly from a portion of the casting 50 at a location that is rearward of the location of the pivot shaft 118. A suitable torsion spring 126 is interconnected between the outwardly protruding boss 124 and the arm 117 so as to bias the arm 117 in a counter clockwise direction as viewed in FIG. 5. The construction and arrangement is such that the fifth planar portion 110 is continuously urged upwardly and rearwardly by the torsion spring 126 acting on the arm 117 so that the upper surface of the portion 110 is normally maintained in the horizontal position that is contiguous with the registration plane.

A complete cycle of operation of the flap closing device 42 of the mailing machine 10 will now be described with particular reference to FIGS. 9 through 14. FIG. 9 shows the position of the parts of the flap closing device 42 in their normal or home position, i.e., when there is no envelope passing through the flap closing device 42. An envelope E is just entering the rollers 37 and 39 of the take away roller assembly 35 prior to passing the flap moistening device represented by the moistening belt 38, with the flap F extending downwardly from the far edge of the envelope so that the gummed strip G is facing forwardly, i.e., toward the viewer of the figure. As previously mentioned, the upper end of the downstream edge 94 of the fixed flap closing element 74 is spaced downwardly from the registration plane, i.e., the underside of the lower run 54' of the belt 54 to provide a space S therebetween, the length of the space S determining the maximum thickness of envelopes that the flap closing device 42 can accommodate.

Figure 10:
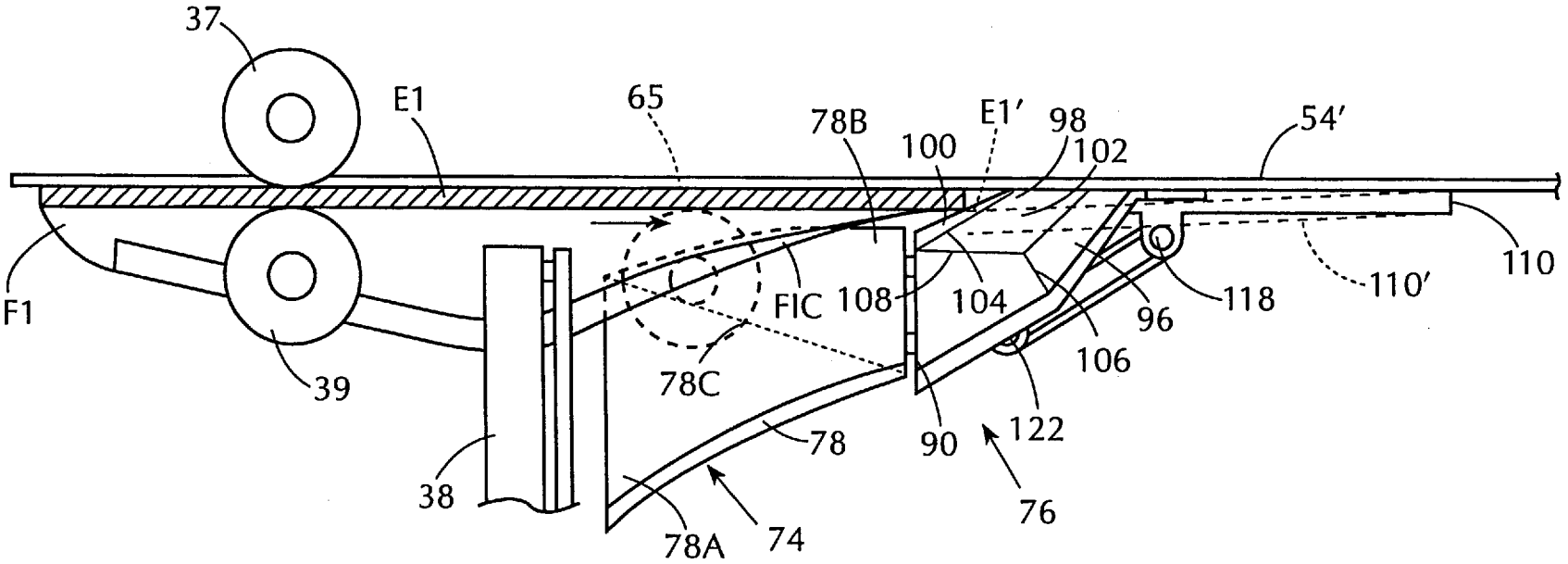
FIG. 10 is a fragmentary side view, drawn to an enlarged scale, of a portion of the mailing machine showing a thin envelope passing over the fixed flap closing element with the lead edge of the envelope having engaged but not yet depressed the movable flap closing element.

Referring now to FIG. 10, as the envelope E moves forwardly into the nip of the under surface of the lower run 54' of the belt 54 and the first of the spring loaded back up pressure rollers 65, and assuming that this is a relatively thin envelope as designated E1, the opposite non-gummed surface of the flap F1 makes contact with the surface of the fixed flap closing element 74 somewhere along the upstream edge portion of the triangular portion 78A, the precise location of this initial contact depending on the configuration of the flap F1, i.e., whether it is a shallow flap for an envelope having a relatively straight throat configuration, or a deep V flap for a correspondingly shaped throat. FIG. 10 illustrates the former configuration so that the flap F1 would initially contact the surface of the portion 78A more toward the upper portion thereof. Due to the compound curvature of the upper surface of the entire fixed flap closing element 74, the flap F1 is gradually urged forwardly, i.e., toward the viewer, and also upwardly, as indicated by the curvature in the portion of the flap F1 labeled F1C. In actual practice, the nature and construction of the flap moistening device, as represented by the moistening belt 38, is such that the envelope exists the moistening device with the flap already turned about 30° from vertical, and the fixed flap closing element 74 turns it about another 25° to 30°, depending on the configuration of the flap. It should also be noted that in FIG. 10, the leading edge of the envelope E1 has just made initial contact with the forth planar portion 100 of the movable flap closing element 76, but has not yet moved it from its home position so that the fifth planar portion 110 is still in full face contact with the under surface of the belt 54', i.e. the registration plane, in response to the force imposed on the arm 117 by the torsion spring 126.

Still referring to FIG. 10, as the envelope E1 moves further through the flap closing device 42, the leading edge of the envelope E1 contacts the body member 88 somewhere along the fourth planar portion 100 depending on the thickness of the envelope E1, and thereby exerts a camming effect on the surface of the fourth planar portion 100 to urge the body member 88 in a forward direction. This camming action initially pivots the body member 88 in a counter clockwise direction by simultaneously depressing the upstream end portion of the fifth planar portion 110 and the arm 117 about the lower pivot shaft 122 and permitting the fifth planar portion 110 to pivot about the upper pivot shaft 118 in the same direction so that the downstream end of the fifth planar portion 110 remains in contact with the undersurface of the lower run 54' of the belt 54. This movement of the body member 88 continues until there is a sufficient gap between the registration plane and the upper surface of the fifth planar portion 110 to accommodate the thickness of the lead edge of the envelope E1. This condition is shown by the dotted line position of the leading edge of the envelope E1' and the fifth planar portion 110' in FIG. 10. However, as the leading edge E1' moves across the upper surface of the fifth planar portion 110, it further urges the body member 88 to press downwardly on the arm 117 and pivot the arm 117 about the lower pivot shaft 122, until the leading edge E1' passes the upper pivot shaft 118, at which time the fifth planar portion 119 is pivoted a clockwise direction about the upper pivot shaft 118 so that the upper surface of the fifth planar portion 110 will again lie in a horizontal plane that is spaced from the registration plane by the thickness of the envelope E1, as seen in FIG. 11.

Simultaneously with the foregoing movement of the body member 88, the flap F1 of the envelope E1 contacts the first planar portion 90 at some point thereon, depending on the configuration of the flap F1, which effects further closing movement of the flap F1 toward the rear panel of the envelope E1. Still further movement of the envelope E1 causes the flap F1 to slide smoothly over the curved junctures 106 and 108 onto the second and third planar portions 96 and 98 so as to effect still further closure of the flap F1 toward the back panel of the envelope E1. Again the precise location at which the flap F1 contacts the second and third planar portions 96 and 98 depends on the particular configuration of the flap F1. Finally, as the flap F1 passes over the junctures 112 and/or 114, as the case may be, the upper surface of the fifth planar portion 110 effectively fully closes the flap F1 and presses the moistened gummed portion thereof against the underside of the rear panel of the envelope E1 to seal it thereto under the urging of the torsion spring 126 acting on the arm 117 and the body member 88.

Figure 11:
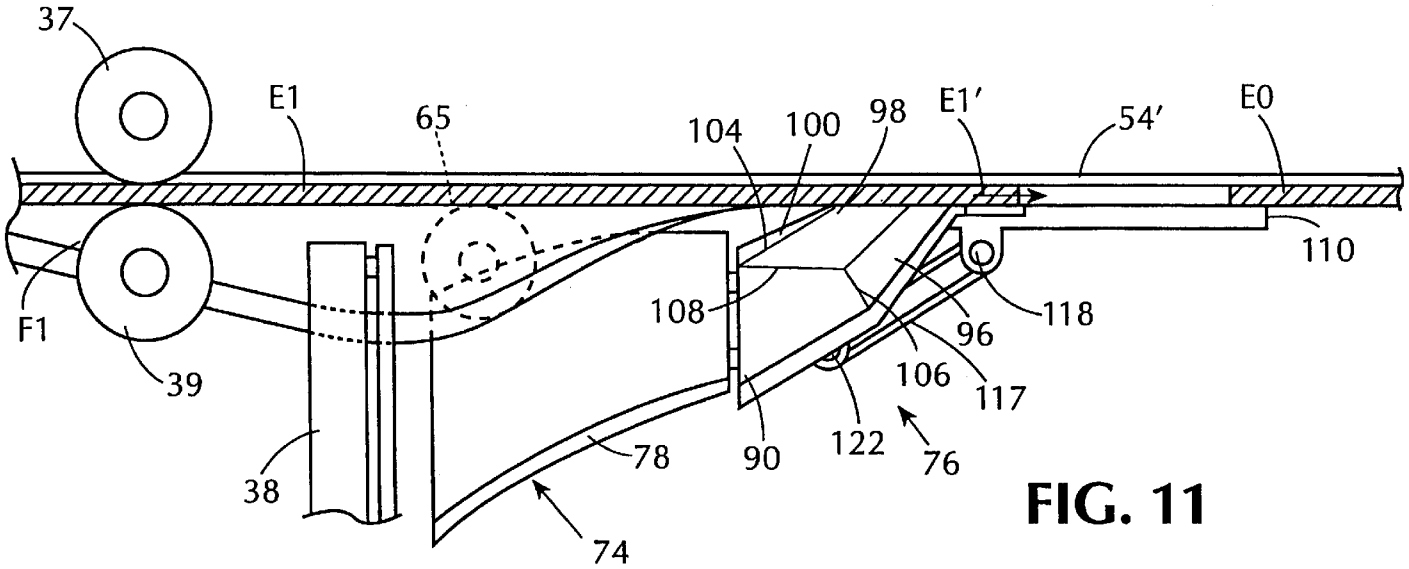
FIG. 11 is a view similar to FIG. 10 showing the thin envelope of FIG. 10 exiting the movable flap closing element and another thin envelope passing over both the primary and movable flap closing elements, with both envelopes maintaining the movable flap closing element depressed beneath, but still lying parallel to, the registration plane.

FIG. 11 also shows the condition that exists when two consecutive envelopes of the same thickness are fed through the flap closing device 42, and both are of the same thickness. Thus, an envelope E', which has already traversed the path and distance described above with respect to the envelope E1, is shown with the trailing edge portion thereof passing over the downstream end portion of the fifth planar portion 110. At the same time, the leading edge portion of the envelope E1 is passing over the upstream end portion of the fifth planar portion 110 of the body member 88. During normal operation of the mailing machine 10, successive envelopes are fed in such a manner that the distance between the trailing edge of a preceding envelope and the leading edge of a succeeding envelope is less than the length of the upper surface of the fifth planar portion 110, with the result that the orientation of the body member 88, as well as the gap between the registration plane and the upper surface of the fifth planar portion 110, remain unchanged as long as the thickness of the envelopes being fed over the body member 88 remains unchanged.

Figure 12:
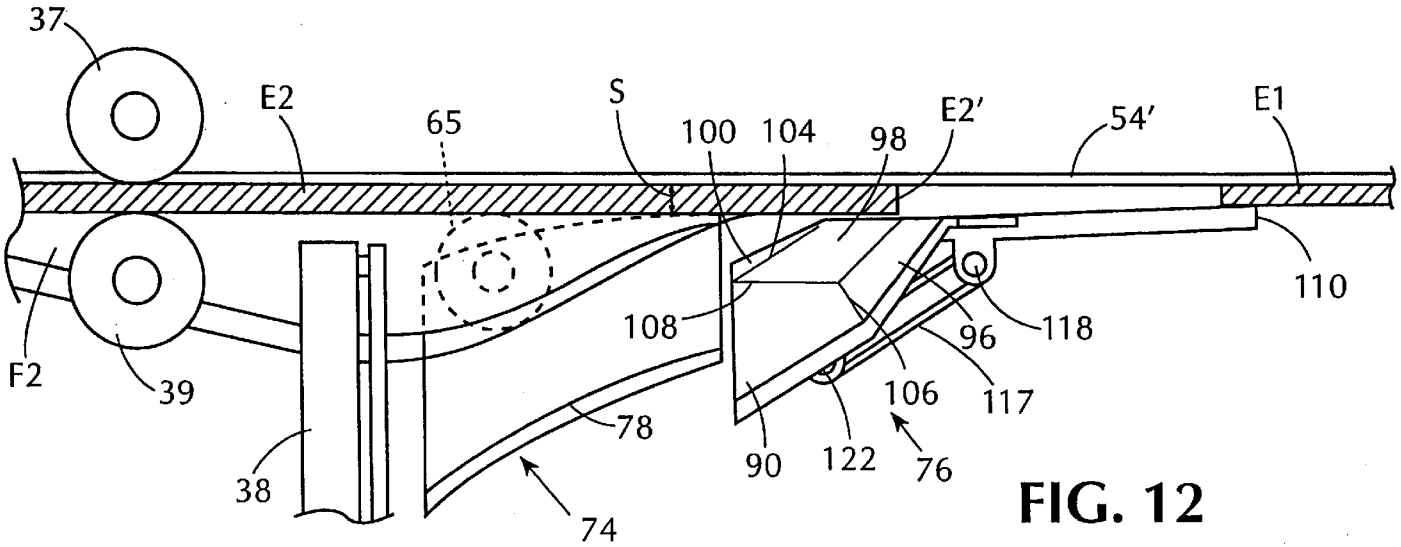
FIG. 12 is a view similar to FIG. 11 showing the second thin envelope of FIG. 11 existing the movable flap closing element and a thick envelope passing over the fixed flap closing element with the leading edge of the thick envelope having just engaged and depressed the upstream end of the movable flap closing element, to depress the upstream end thereof more than the downstream end so that the movable flap closing element is at an angle to the registration plane.

Referring now to FIG. 12, the condition of a thick envelope following a thin envelope through the flap closing device 42 is shown. Thus, FIG. 12 shows the thin envelope E1 with the trailing edge thereof passing over the downstream end portion of the fifth planar portion 110, and a thick envelope E2 passing over the fixed flap closing element 74, with the leading edge of the envelope E2 having already engaged the fourth planar portion 100. In a manner similar to the movement of the body member 88 as explained above in connection with FIG. 10, this exerts a further camming effect on the body member 88 as described above to further depress the upstream end of the fifth planar portion 110 against the biass of the torsion spring 126 acting on the arm 117, until there is a sufficient gap between the registration plane and the upper surface of the upstream end portion of the fifth planar portion 110 to accommodate the thickness of the lead edge of the thicker envelope E2. This condition is shown by the solid line position of the fifth planar portion 110 in FIG. 12. However, in the same manner as described above in connection with the envelope E1 in FIG. 10, as the leading edge E2' moves across the upper surface of the fifth planar portion 110, it further urges the both member 88 to press downwardly on the arm 117 and pivot the arm 117 about the lower pivot shaft 122, until the leading edge E2' passes the upper pivot shaft 118, at which time the fifth planar portion 119 is pivoted a clockwise direction about the upper pivot shaft 118 so that the upper surface of the fifth planar portion 110 will again lie in a horizontal plane that is spaced from the registration plane by the thickness of the envelope E2, as seen in FIG. 13.

Simultaneously with the just described movement of the body member 88, the flap F2 contacts the first planar portion 90 at some point thereon, depending on the configuration of the flap F2, and is further partially closed thereby and is still further partially closed and then fully closed by the third, fourth and fifth planar portions 96, 98 and 110 respectively, all as fully described above in connection with the flap F1 and as shown in FIG. 11.

Figure 13:
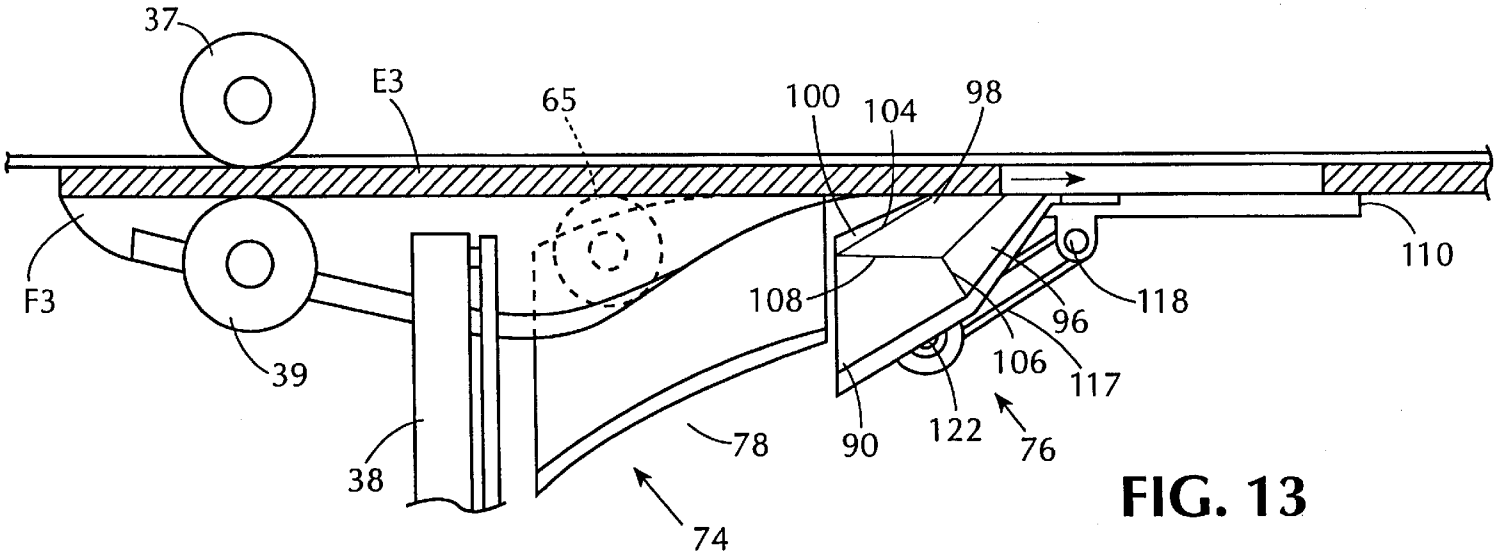
FIG. 13 is a view similar to FIG. 11 showing a thick envelope exiting the movable flap closing element and another thick envelope passing over both the primary and movable flap closing elements, with both envelopes maintaining the movable flap closing element depressed beneath but again still lying parallel to the registration plane.

In a manner similar to FIG. 11, FIG. 13 shows the condition that exists when two consecutive thick envelopes are being fed through the flap closing device 42. Thus, it will be seen that the trailing edge of the thick envelope E2 is exiting the fifth planar portion 110, and the leading edge portion of the envelope E3 is passing over the upstream portion thereof, with the result that, as before, two successive envelopes of the same thickness will maintain the fifth planar portion 110 in a horizontal plane parallel to the registration plane, but at a distance spaced further than that shown above in FIG. 11.

Figure 14:
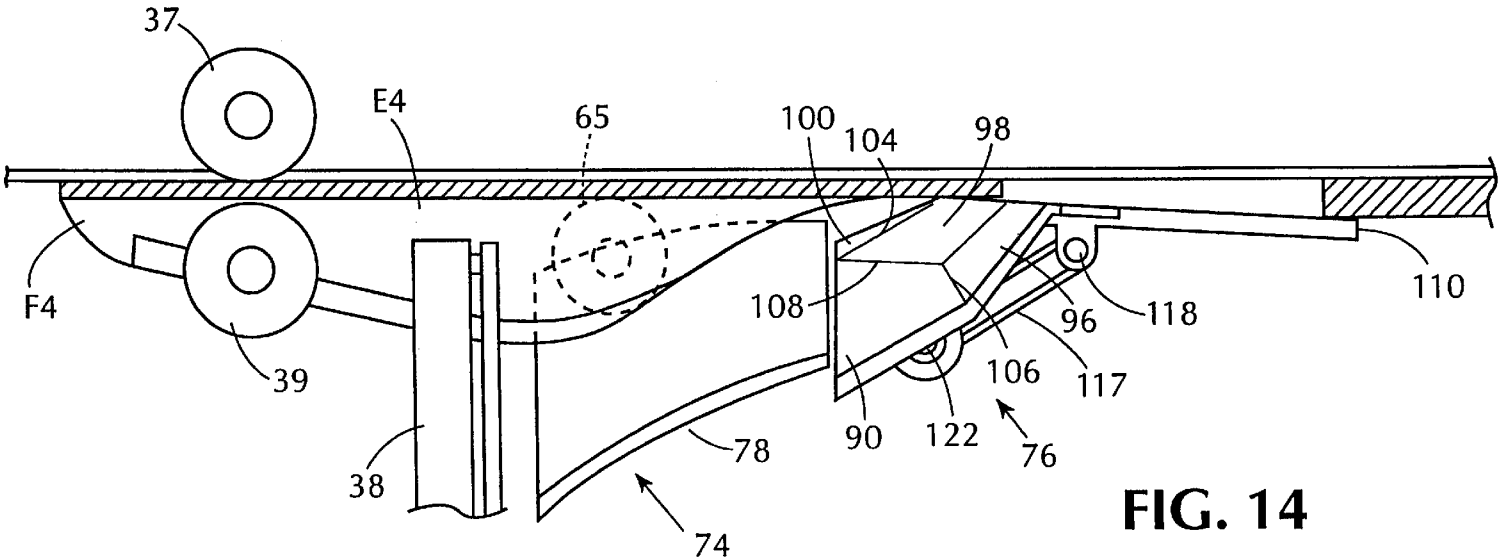
FIG. 14 is a view similar to FIG. 11 showing the second thick envelope of FIG. 13 exiting the movable flap closing element and a thin envelope passing over the fixed flap closing element, with the leading edge of the thin envelope having just engaged and depressed the upstream end of the movable flap closing element to depress the upstream end thereof less than the downstream end so that the movable flap closing element is at an angle to the registration plane that is opposite to that shown in FIG. 12.

FIG. 14 illustrates the condition that exists when a thin envelopes follows a thick envelope through the flap closing device 42. Thus, the thick envelope E3 is shown passing over the downstream portion of the fifth planar portion 110, and the leading edge of a thin envelope E4 is just passing over the upstream end portion of the fifth planar portion 110. Once the trailing edge of the envelope E3 passes the upper pivot shaft 118, it has moved sufficiently far along the length of the fifth planar portion 110 to allow the upward force of the torsion spring 126 acting on the arm 117 to both pivot the arm 117 in a counter clockwise direction and to pivot the entire body member 88 about the pivot shaft 118 in a clockwise direction relative to the arm 117 with the result that the upstream end of the fifth planar portion 119 moves upwardly, as indicated by the arrow B, to press against the underside of the thin envelope E4 to maintain the opposite surface thereof in the registration plane. As soon as the trailing edge of the thick envelope E3 passes the downstream end of the fifth planar portion 110, the entire body member 88 will again pivot about the upper pivot shaft 118 in a counter clockwise direction so it will return to the same horizontal orientation shown in FIG. 11, and the full surface of the fifth planar portion 110 will then press against the under surface of the envelope and the flap F4 thereof to cause it to be effectively closed and sealed. This same action will be repeated as the envelope E4 exits from the fifth planar portion 110, which will then return to the normal position shown in FIG. 9.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. A mailing machine for printing postage indicia on the upper surface of envelopes passing through the mailing machine with the flaps thereof open and extending generally downwardly from the upper surface of the envelopes, said mailing machine comprising:

envelope transport means defining an envelope feed path extending through the mailing machine for transporting envelopes therealong from an infeed location to an outfeed location, a digital ink jet printing device disposed adjacent said outfeed location of said feed path, said printing device including a print head having a plurality of ink jet nozzles disposed in a predetermined plane for depositing ink in a predetermined image pattern on the upper surfaces of said envelopes traveling along said feed path, means defining a registration plane for said upper surfaces of said envelopes being transported along a portion of said feed path adjacent said outfeed location, said registration plane being disposed at a predetermined distance beneath said plane of said ink jet nozzles, and an envelope flap closing device disposed in said portion of said feed path in an upstream direction from said printing device for closing the flaps of said envelopes as they are transported along said portion of said feed path prior to reaching said printing device, said flap closing device including means responsive to varying thicknesses of said envelopes for ensuring that the flaps thereof are effectively closed regardless of the thickness of said envelopes within a predetermined range of thickness.

2. A mailing machine as set forth in claim 1 wherein said means defining said registration plane for said upper surfaces of said envelopes includes fixed guide means extending along and partially overlying a portion of said feed path in a position to be contacted by said upper surfaces of said envelopes being transported along said feed path, said guide means having a lower surface disposed at said predetermined distance beneath said ink jet nozzles so as to lie in said registration plane.

3. A mailing machine as set forth in claim 2 wherein said means defining said registration plane further includes a portion of said transport means which is co-planar with said lower surface of said guide means.

4. A mailing machine for printing postage indicia on the upper surface of envelopes passing through the mailing machine with the flaps thereof open and extending generally downwardly from the upper surface of the envelopes, said mailing machine comprising:

envelope transport means defining an envelope feed path extending through the mailing machine for transporting envelopes therealong from an infeed location to an outfeed location;

a digital ink jet printing device disposed adjacent said outfeed location of said feed path, said printing device including a print head having a plurality of ink jet nozzles disposed in a predetermined plane for depositing ink in a predetermined image pattern on the upper surfaces of said envelopes traveling along said feed path;

means defining a registration plane for said upper surfaces of said envelopes being transported along a portion of said feed path adjacent said outfeed location, said registration plane being disposed at a predetermined distance beneath said plane of said ink jet nozzles; and an envelope flap closing device disposed in said portion of said feed path in an upstream direction from said printing device for closing the flaps of said envelopes as they are transported along said portion of said feed path prior to reaching said printing device, said flap closing device including means responsive to varying thicknesses of said envelopes for ensuring that the flaps thereof are effectively closed regardless of the thickness of said envelopes within a predetermined range of thickness;

wherein said means defining said registration plane for said upper surfaces of said envelopes includes fixed guide means extending along and partially overlying a portion of said feed path in a position to be contacted by said upper surfaces of said envelopes being transported along said feed path, said guide means having a lower surface disposed at said predetermined distance beneath said ink jet nozzles so as to lie in said registration plane; and wherein said means defining said registration plane further includes a portion of said transport means which is co-planar with said lower surface of said guide means; and wherein said portion of said transport means comprises:

an endless belt mounted on said mailing machine in a position to have a linear lower run thereof overlying said flap closing device and underlying said ink jet printing device, with the lower surface of said lower run also lying in a plane that is co-planar with said guide means so as to also lie in said registration plane;

pressure means disposed along the opposite surface of said linear lower run of said belt for urging envelopes into driving engagement with said lower run of said belt so that said upper surfaces of said envelopes are in said registration plane; and means for driving said belt.

5. A mailing machine as set forth in claim 4 wherein said flap closing device comprises:

a fixed flap closing element for partially closing the flaps of envelopes passing through said flap closing device, a movable flap closing element for completing the closure of the flaps of envelopes passing through said flap closing device to bring the flaps into contact with the rear surfaces of said envelopes, and means mounting said movable flap closing element for movement relative to said first flap closing element so that said movable flap closing element causes said flaps of said envelopes being through said flap closing device to be brought into contact with the rear surfaces of said envelopes regardless of the thickness of said envelopes within a predetermined range of thickness.

6. A mailing machine as set forth in claim 5 wherein said fixed flap closing element comprises:

a generally rectangular body member, said body member having opposed triangular shaped portions disposed on opposite sides of a diagonal axis, each of said portions being depressed out of the plane of said diagonal axis such that one pair of adjacent surfaces of said portions together define a convex surface across said diagonal axis, and means mounting said fixed flap closing element in said mailing machine adjacent the upstream end of said lower run of said belt in a manner such that said downwardly extending flaps of said envelopes passing over said fixed flap closing element engage a portion of said convex surface and are partially closed during said movement of said envelopes over said fixed flap closing element.

7. A mailing machine as set forth in claim 6 wherein said convex surface is angled upwardly both in the longitudinal direction of movement of said envelopes and also in a transverse direction perpendicular to said longitudinal direction toward the edges of said envelopes to which said flaps thereof are attached, so that said convex surface is engaged by said downwardly extending flaps at some location thereon depending on the thickness of said envelopes or the configuration of said flaps.

8. A mailing machine as set forth in claim 7 wherein said body member includes a downstream edge extending across said envelope feed path in said transverse direction, the upper end of said downstream edge being disposed at a predetermined distance beneath said registration plane, said predetermined distance defining the maximum thickness envelope that said flap closing device will accommodate.

9. A mailing machine as set forth in claim 8 wherein said movable flap closing element comprises a body member having:

a first generally rectangular planar portion having an upstream edge that is co-planar with a major portion of the length of said downstream edge of said fixed flap closing element and being angled upwardly to effect further closure of said flaps, second, and third generally rectangular planar portions joined to said first planar portion along the downstream edges of said first planar portion, said second and third planar portions also being joined together along an edge perpendicular to said downstream edges of said first planar portion and being further angled upwardly to effect further closure of said flaps, and a fourth relatively narrow generally rectangular planar portion joined to said first and third planar portions and having an upstream edge thereof that is co-planar with the remaining portion of said upstream edge of said first planar portion and being positioned to intercept the leading edges of envelopes to move said movable flap closing element to accommodate envelopes of different thickness, and a fifth generally rectangular planar portion joined to said second, third and fourth planar portions along edges generally parallel to said upstream edge of said first planar portion, and lying in a plane that is parallel to said registration plane to effect final closure of said flaps.

10. A mailing machine according to claim 9 wherein said first planar portion lies in an upwardly angled plane that is substantially co-planar with the plane of said fixed flap closing element along said downstream edge thereof, so as to substantially continue the upwardly angled plane of said fixed flap closing device along said downstream edge thereof, and said second and third planar portions lie in planes that are angled upwardly more sharply than said upwardly angled plane of said first planar portion.

11. A mailing machine according to claim 10 wherein said means mounting said movable flap closing element for movement relative to said first flap closing element comprises an elongate arm having an upper end thereof pivotally connected to the underside of said body member of said movable flap closing element adjacent the juncture of said fifth planar portion with said second and third planar portions, the lower end of said arm being pivotally connected to a portion of the mailing machine at a location spaced in an upstream direction from said connection of said arm with said body member, and means biasing said arm upwardly about said lower end thereof so as to normally maintain said fifth planar portion of said body member in firm engagement with the lower surface of said lower run of said belt in the absence of envelopes being fed through said flap closing device and with the lower surfaces of envelopes being fed through said flap closing device.

12. A mailing machine according to claim 11 wherein said plane of said fourth planar portion is angled upwardly more sharply than said plane of said fixed flap closing element at the juncture of said fourth planar portion with said fixed flap closing element so as to present a substantially upwardly angled plane to the leading edges of envelopes moving from said first flap closing element to said second flap closing element so that said fourth planar portion acts as a camming surface to depress said body member of said movable flap closing element in an arcuate direction about said upper pivotal connection of said arm to said body member.

13. A mailing machine comprising:

a casing;

a transport means for feeding an envelope having a body and a flap along an envelope feed path, the envelope feed path for transporting envelopes therealong from an infeed location to an outfeed location;

a flap closing device mounted to said casing adjacent to said transport means comprising:

a fixed flap closing element mounted on said casing, said fixed flap closing element comprising an upper surface disposed with the envelope feed path for initiating partial closure of the envelope flap; and a movable flap closing element pivotally mounted to said casing in a position downstream from said fixed flap closing element comprising:

an arm pivotally mounted on said casing and interconnected with a torsion spring so as to bias said arm toward the envelope feed path; and a planar portion pivotally mounted on said arm and disposed with the envelope feed path for completing closure of the envelope flap.

14. A mailing machine as claimed in claim 13, further comprising:

a flap moistening device positioned upstream from said fixed flap closing element along the envelope feed path.

15. A mailing machine as claimed in claim 13, further comprising:

a registration plane co-planar to a portion of said transport means, whereby said planar portion of said movable flap closing element is normally maintained in a horizontal position that is contiguous with the registration plane.

16. A mailing machine as claimed in claim 13 whereby said arm of said movable flap closing element is biased in a counterclockwise direction.

17. A mailing machine as claimed in claim 13 whereby said planar portion of said movable flap closing element pivots in clockwise and counter clockwise directions.

18. A flap closing device for an envelope processing machine, having an envelope feed path, comprising:

a fixed flap closing element for closing an envelope having a body and a flap, said fixed flap closing element comprising an upper surface disposed with the envelope feed path for initiating partial closure of the envelope flap; and a movable flap closing element pivotally mounted in a position downstream from said fixed flap closing element comprising:

an arm pivotally mounted and including a torsion spring so as to bias said arm toward the envelope feed path; and a planar portion pivotally mounted on said arm and disposed with the envelope feed path for completing closure of the envelope flap.

19. The flap closing device as claimed in claim 18, further comprising:

a flap moistening device positioned upstream from said fixed flap closing element along the envelope feed path.

20. The flap closing device as claimed in claim 18, further comprising:

a registration plane disposed with the envelope feed path, whereby said planar portion of said movable flap closing element is normally maintained in a horizontal position that is contiguous with the registration plane.

21. The flap closing device as claimed in claim 18, whereby said arm of said movable flap closing element is biased in a counterclockwise direction and whereby said planar portion of said movable flap closing element pivots in clockwise and counter clockwise directions.

* * * * *